US005912443A

United States Patent [19]

Hasunuma

[11] Patent Number: 5,912,443

[45] Date of Patent: Jun. 15, 1999

[54] MEMBRANE TYPE KEYBOARD WITH IMPROVED MULTIPLE KEY ARRANGEMENT

[75] Inventor: Seigo Hasunuma, Gunma, Japan

[73] Assignee: Hosiden Corporation, Osaka, Japan

[21] Appl. No.: 09/019,723

[22] Filed: Feb. 6, 1998

Related U.S. Application Data

[63] Continuation of application No. 08/677,319, Jul. 2, 1996, Pat. No. 5,763,841.

[30] Foreign Application Priority Data

Jul. 7, 1995 [JP] Japan ..... 7-171999

[51] Int. Cl.[6] ..... H01H 13/70; H01H 3/12

[52] U.S. Cl. ..... 200/5 A; 200/517; 200/343; 200/345

[58] Field of Search ..... 200/5 A, 512–517, 200/329–345, 293–307; 400/490–496

[56] References Cited

U.S. PATENT DOCUMENTS

| | | | |
|---|---|---|---|
| 4,351,988 | 9/1982 | Allbright | 200/5 A |
| 4,582,967 | 4/1986 | Brumit et al. | 200/5 A |
| 5,144,103 | 9/1992 | Suwa | 200/344 |
| 5,340,955 | 8/1994 | Calvillo et al. | 200/302.2 |
| 5,430,263 | 7/1995 | English et al. | 200/5 A |
| 5,481,074 | 1/1996 | English | 200/5 A |

FOREIGN PATENT DOCUMENTS

| | | | |
|---|---|---|---|
| 0 565 959 | 10/1993 | European Pat. Off. | H01H 13/70 |

*Primary Examiner*—J. R. Scott
*Attorney, Agent, or Firm*—Pollock, Vande Sande & Amernick

[57] ABSTRACT

In a keyboard which drives membrane switches by selectively depressing key tops, hinge portions are formed integrally with a housing in an array of hinge receiving holes made therein in correspondence with a desired array of key tops, a top panel having openings corresponding to the hinge receiving holes is bonded to the top of the housing and the key tops are each disposed to cover the corresponding opening and the entire length of the corresponding hinge portion and is fixedly engaged with the free end of the hinge portion through the opening. By the application of pressure to and its removal from each key top, the lower end of the free end of the corresponding hinge portion operates to make and break the underlying membrane switch.

4 Claims, 6 Drawing Sheets

MEMBRANE TYPE KEYBOARD WITH IMPROVED MULTIPLE KEY ARRANGEMENT

CROSS REFERENCE TO RELATED APPLICATION

This application is a continuation of Hasunuma application Ser. No. 08/677,319, filed Jul. 2, 1997, now U.S. Pat. No. 5,763,841.

BACKGROUND OF THE INVENTION

The present invention relates to a keyboard and, more particularly, to a keyboard in which hinge portions for holding a key top are molded integrally with a housing, the key top being fixedly engaged with hinge portion.

Referring first to FIGS. 1A and 1B, a prior art example will be described. FIG. 1A is a partial top plan view of a keyboard showing several key tops 2 and FIG. 1B is a partial sectional view taken along line 1B—1B of FIG. 1A.

Reference numeral 20 denotes a keyboard housing which has rectangular key tops 2 fitted and held in rectangular openings 21 formed at regular intervals in the housing 20. Each of the key tops 2 has an edge flange 2*a* extended from the periphery of its lower end. Reference numeral 3 denotes an elastic rubber sheet, 3*a* is an upward projection formed by embossing in the rubber sheet 3 and having a downward protrusion 3*b* extended from its underside, 4A is an upper conductor pattern sheet having movable contact segments 41 is formed corresponding to the key tops 2, respectively, and 4B is a lower conductor pattern sheet which is separated from the upper conductor pattern sheet 4A by a separator sheet 4C of a synthetic resin material and bonded to the upper surface of a backing board 8. The lower conductor pattern sheet 4B has fixed contact segments 42 formed therein at places opposite the movable contact segments 41, respectively. Each pair of opposed contact segments 41 and 42 constitutes a switching part 4S. The separator 4C has cells 4*h* formed by punching its areas corresponding to the protrusions 3*a* of the rubber sheet 3, each cell forming a space through which the movable and fixed contact segments make and break contact. The upper and lower conductor pattern sheets 4A and 4B and the separator 4C constitute a membrane switch 40. The rubber sheet 3, the membrane switch 40 and the backing board 8 are housed in the housing 20.

In the keyboard shown in FIGS. 1A and 1B, the keytops 2 are each normally pressed upward by the elastic projection 3*a* with the edge flange 2*a* lightly pressed against the inner wall of the housing 20 in the vicinity of the aperture 21. Accordingly, the top faces of the key tops 2 arranged on the keyboard are held at the same height above the top surface of the housing 20. When the key top 2 is depressed the projection 3*a* of the rubber sheet 3 is elastically deformed downward and its downward protrusion 3*b* presses down the area of the upper conductor pattern sheet 4A opposite the cell 4*h* to bring the movable contact segment 41 into contact with the fixed contact segment of the lower conductor pattern sheet 4B, causing the switching part 4S to make contact. Upon removal of the pressure applied to the key top 2 the projection 3*a* is restored to its original position, causing the switching part 4S to break contact.

In the prior art example depicted in FIGS. 1A and 1B the key tops 2 are formed as discrete components. Hence, the edge flange 2*a* of each key top 2, extended around the periphery thereof, is pressed by the elastic projection 3*a* against the lower surfaces of the housing 20 adjacent the four sides of the opening 21, but the pressure applied to the edge flange 2*a* is so small that the key top 2 rattles in the horizontal direction. Moreover, because of the distribution of the height and resiliency of the dome-shaped elastic projections 3*a*, it has been difficult to apply biasing force to all the key tops, uniformily and sufficiently, thus easily causing some key tops to rattle in their up-down direction. As a result, there happens to be some key tops which are uneven in their height. Further, the spacing between the key tops 2 needs to be at least about 3 to 4 mm which corresponds to twice the width of the edge flange 2*a* this significant space in a small keyboard of the type employing a membrane switch The reduction of the width of the edge flange 2*a* is not desirable for ensuring high reliability in its engagement with the underside of the housing 20 along the lower marginal edge of the opening 21.

Turning next to FIGS. 2A and 2B, another prior art example will be described. FIG. 2A is a partial top plan view of a keyboard showing several key tops and FIG. 2B is a sectional view taken along the line 2B—2B of FIG. 2A. The parts corresponding to those in FIGS. 1A and 1B are identified by the same reference numerals.

In FIGS. 2A and 2B, a top panel 11 has rectangular openings 11*h* formed therein at regular intervals, through which the rectangular key tops 2 project upward. Each of the key tops 2 has the edge flange 2*a* extended from one side of its lower end, and the edge flange 2*a* abuts against the lower edge of the opening 11*h* of the top panel 11 bonded to the upper surface of the housing 20, thereby preventing the free end of the key top 2 from getting out of the opening 11*h*. The key tops 2 are each coupled to the housing 20 by coupling arms $\mathbf{22}_1$ and $\mathbf{22}_2$ extended from both ends of the key top 2 on the side opposite to the edge flange 2*a* and are integrally formed with the housing 20. The coupling arms $\mathbf{22}_1$ and $\mathbf{22}_2$ form a hinge portion 22 that is elastically curved. A support wall 23, which extends downward from the section of the housing 20 coupled with the hinge portion 22 is placed on the rubber sheet 3. The rubber sheet 3 has upward projections 3*a* located under the key tops 2 and each projection 3*a* has the downward protrusion 3*b* on its underside.

The upper conductor pattern sheet 4A has in its lower surface the movable contact segments 41 formed in one-to-one correspondence with the key tops 2. The lower conductor pattern sheet 4B is bonded to the upper surface of the substrate 8 and has the fixed contact segments 42 at areas facing the movable contact segments 41 of the upper conductor pattern sheet 4A. Each pair of movable and fixed contact segments 41 and 42 constitute the switching part 4S. The separator sheet 4C of synthetic resin has the cells 4*h*formed by punching its areas corresponding to the projections 3*a* of the rubber sheet 3, the movable and fixed contact segments 41 and 42 facing each other in each cell 4*h*. The upper and lower conductor pattern sheets 4A and 4B and the separator 4C constitute the membrane switch sheet 40.

In the keyboard shown in FIGS. 2A and 2B, the key top 2, the hinge portion 22 and the housing 20 are integrally molded and the key top 2 is normally pressed upward by the elasticity of the hinge portion 22 with the edge flange 2*a* of the key top 2 pressed against the underside of the top panel 11 adjoining the opening 11*h*. When depressing the key top 2, the projection 3*a* of the rubber sheet 3 is elastically deformed downward and consequently presses down the protrusion 3*b*, by which the upper conductor pattern sheet 4A is elastically deformed downward to press the movable contact segment 41 into contact with the fixed contact segment 42 of the lower conductor pattern sheet 4*b*, causing the switching part 4S to make contact. Upon removing the pressure applied to the key top 2, the projection 3*a* springs back to its original position and the contacts break accordingly, opening the switching part 4S. The keyboard of this type is disclosed in U.S. Pat. No. 4,190,748, for instance.

In the prior art example depicted in FIGS. 2A and 2B, the key tops 2 are each formed integrally with the housing 20 through the hinge portion 22, and hence they do not rattle in the horizontal direction. Since the hinge portion 22 entends from one side of the key top 2 toward the nearest adjacent key top to merge integrally with a support wall 23, and an edge flange 2*a* is formed on the side of the key top 22 opposite from the hinge portion 22, the spacing between adjacent key tops is always larger than the sum of the length of the hinge portion 22 and the width of the edge flange 2*a*. Accordingly, the length of the hinge portion 22 cannot be made larger if it is desired to reduce the spacing between adjacent key tops 2. When depressing the key top 2, the maximum stress is applied to the vicinity of the coupling portion between the hinge portion 22 and the housing 20 and, therefore, when the hinge portion 22 is too short, there is a possibility that an abnormally large force, if applied to the key top 2, would deform the coupling portion in excess of the limit of its elasticity and impair the durability of the whole key top structure. To increase the permissible limit of deformation of the hinge portion 22, it is necessary to increase the length of the hinge portion 22, inevitably resulting in an increase in the spacing between adjacent key tops 2.

SUMMARY OF THE INVENTION

It is therefore an object of the present invention to provide a keyboard in which key tops are closely spaced and and their heights are uniform.

According to the present invention, a keyboard which selectively depressing an array of key tops, comprising:

a backing board on which switch contacts for turning ON and OFF the switches and wiring patterns are formed;

an elastic sheet provided on said backing board, said elastic sheet having dome-shaped projections formed in correspondence with the switch contacts;

a housing provided on said elastic sheet, said housing having formed therein receiving holes for receiving therein said dome-shaped elastic projections, respectively;

hinge portions each formed integrally with said housing to extend from an inner wall surface to near an opposite inner wall surface in a corresponding one of said receiving holes, each said hinge portion having a free-end for depressing and releasing a corresponding one of said dome-shaped elastic projections to actuate ON and OFF a corresponding one of the switches;

a top panel provided on a top surface of said housing, said top panel having formed therein openings located above said receiving holes, respectively; and key tops each fixed to the free-end of a corresponding one of said hinge portions and having a top face protruding above said top panel through a corresponding one of said openings; wherein said free-end of each of said hinge portions has an engagement protrusion formed integrally therewith on at least one side thereof, a lateral recess having a portion of said top panel as a ceiling is formed in one of opposite side walls of a corresponding one of said receiving holes to allow up-down movement of said engagement protrusion therein, said engagement protrusion being biased upward by said hinge portion to abut said ceiling, resiliently, in said lateral recess whereby said key top is positioned in its up-down direction.

With such an arrangements the key tops can be closely spaced regardless of the length of each hinge portion, and since the key tops are biased upward until the engagement protrusions of the free-end of each hinge portion resiliently abut against the underside of the top panel, the heights of the key tops can be held uniform.

DESCRIPTION OF THE PREFERRED EMBODIMENTS

Figure 1A:
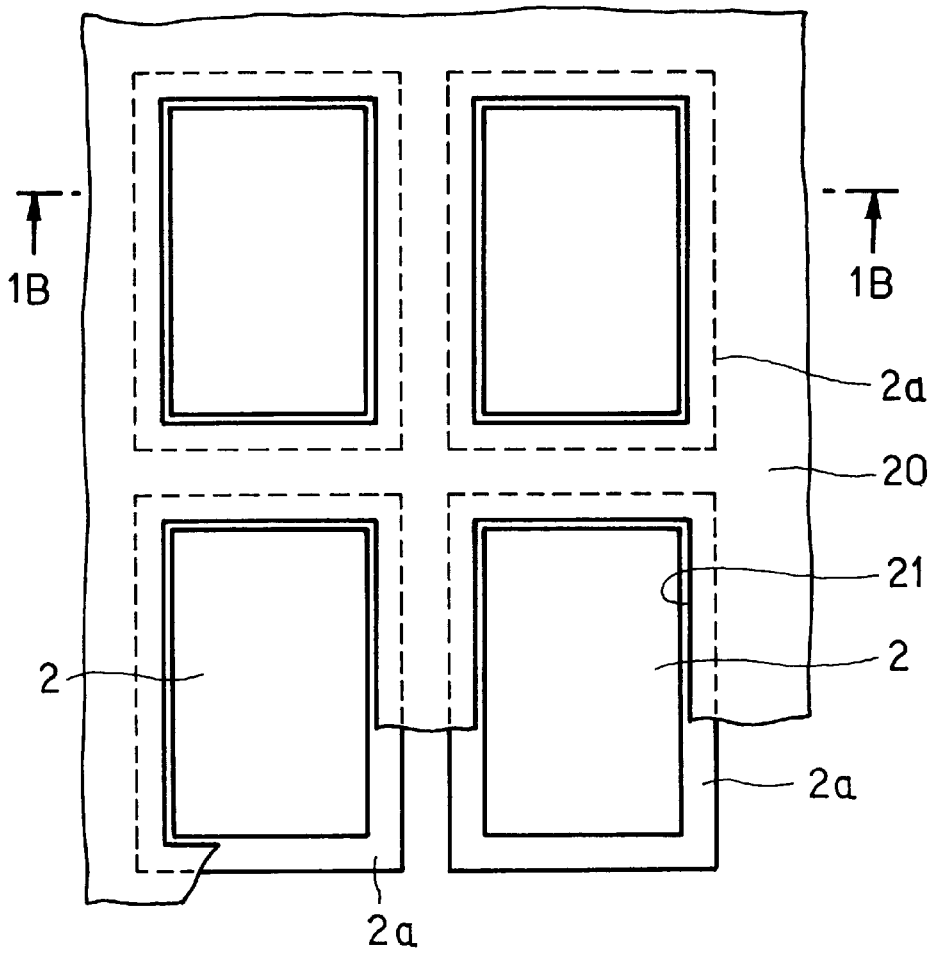
FIG. 1A PRIOR ART
FIG. 1A is a plan view showing an example of a conventional keyboard.
Figure 1B:
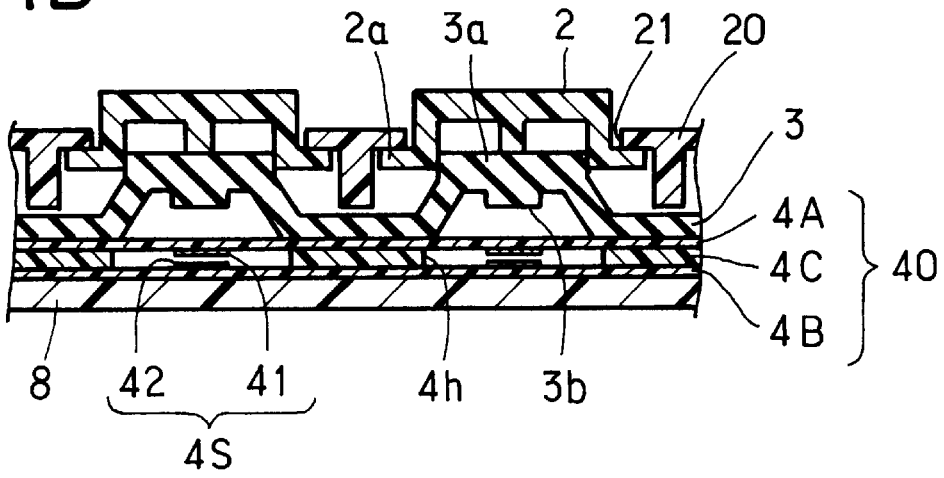
FIG. 1B PRIOR ART
FIG. 1B is a sectional view taken along the line 1B—1B in FIG. 1A.
Figure 2A:
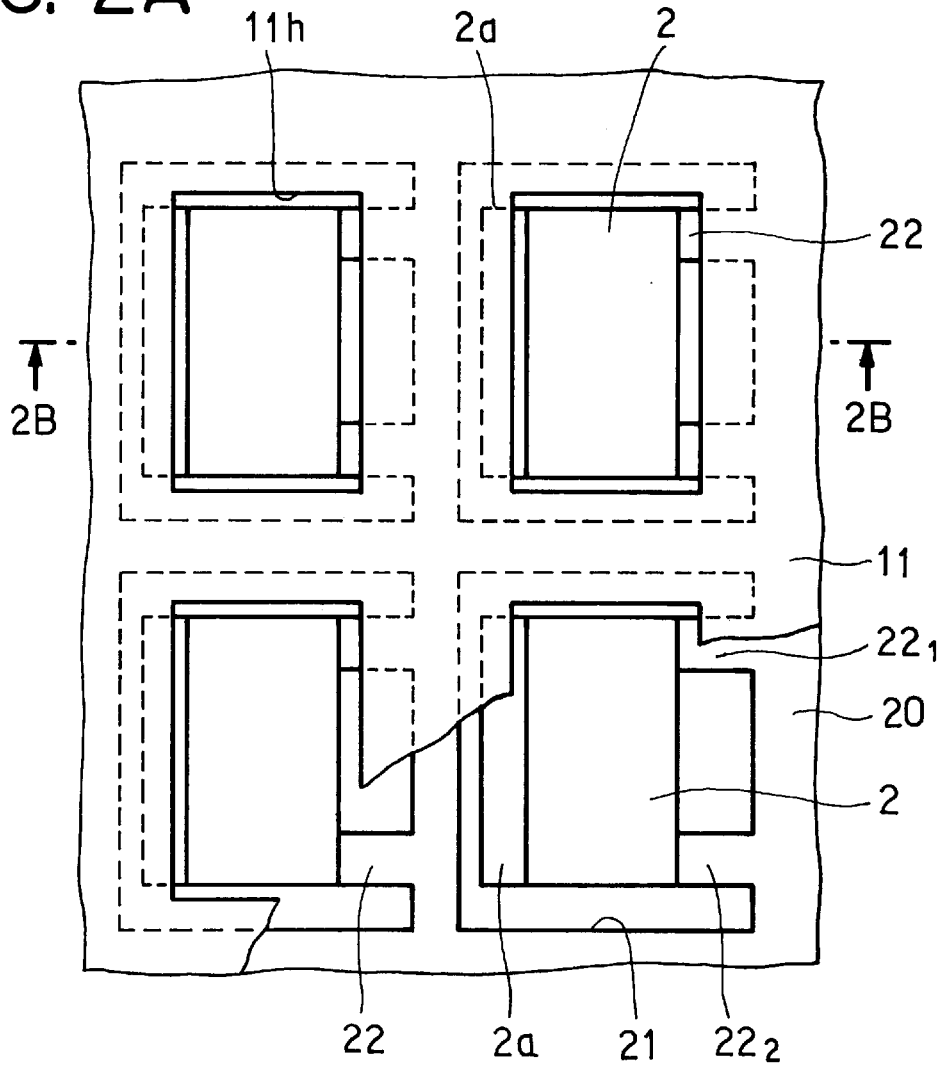
FIG. 2A PRIOR ART
FIG. 2A is a plan view showing another prior art example.
Figure 2B:
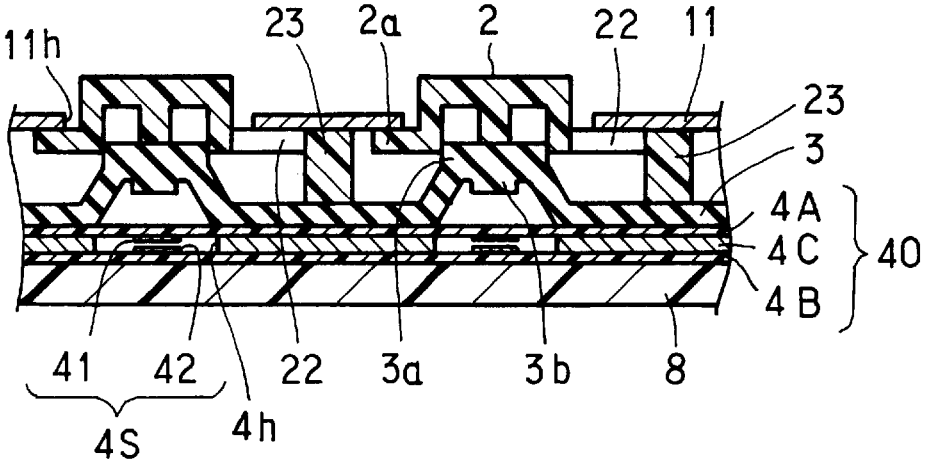
FIG. 2B PRIOR ART
FIG. 2B is a sectional view taken along the line 2B—2B in FIG. 2A.
Figure 3:
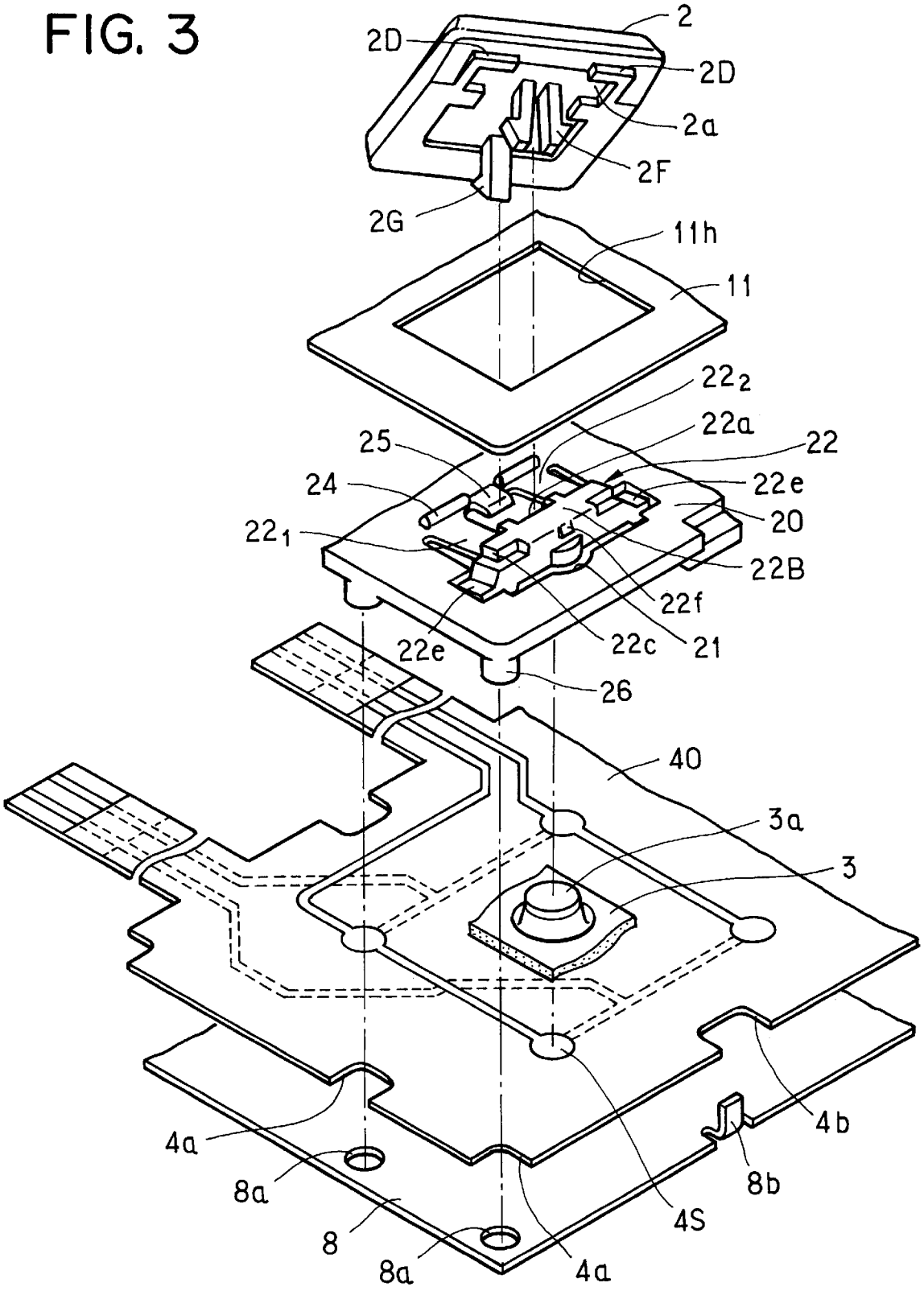
FIG. 3 is a exploded perspective view illustrating one key top and associated parts in an embodiment of the keyboard according to the present invention.

A description will be given, with reference to FIGS. 3 through 6, of an embodiment of the present invention. FIG. 3 is an exploded perspective view illustrating part of the keyboard according to the present inventions the parts corresponding to those in FIGS. 1 and 2 being identified by the same reference numerals. According to the present invention, the hinge portion 22 and the housing 20 are molded integrally, but the key top 2 is formed as a discrete component which is disposed from above the top panel 11 in a manner to cover the entire length of the hinge portion 22 and is secured thereto by engaging hooks 2F with a free end coupling portion 22B of the hinge portion 22 through the opening 11*h* smaller than the outer periphery of the key top 2. With this arrangement, the hinge portion 22 can be made long within the length of the key top 2 even if the spacing between adjacent key tops 2 is reduced.

In FIG. 3, the housing 20 is formed by molding rigid but elastic synthetic resin into a board-like form In the housing 20 there are formed, as hinge receiving holes 21, an array of substantially square openings corresponding to the areas of the key tops 2 which are arranged thereon. A pair of flat coupling arms $\mathbf{22}_1$ and $\mathbf{22}_2$ extending from one side of the hinge receiving hole 21 toward the opposite side thereof are molded as the hinge portion 22 integral with the housing 20. In FIGS. 3 through 6, only one key top 2 and the hinge portion 22 are shown. The two coupling arms $\mathbf{22}_1$ and $\mathbf{22}_2$, which form the hinge portion 22, are connected at one end to an inner wall 21*w* (see FIG. 4) of the receiving hole 21 integrally therewith and their free ends are coupled together by a coupling portion 22B. The two coupling arms $\mathbf{22}_1$ and $\mathbf{22}_2$ are extended obliquely upward from the inner wall 21*w* of the hole 21 at a position lower than the top of the housing 20. The coupling portion 22B has L-shaped engaging portions 22*e* extending down from its opposite ends and then projecting outward in opposite directions. The engaging portions 22*e* extend into recesses 21*a* (FIG. 5) made in opposite side walls of the hinge receiving hole 21 immediately below the top panel 11 and abut against the underside of the top panel 11, preventing the coupling portion 22B from projecting upward in excess of a predetermined height. Accordingly, the coupling portion 22B is elastically biased upward by the elasticity of the hinge portion 22 and provides appropriate tactile feedback to the keyboard user.

Reference numeral 25 denotes an engaging pieces which is molded in an inverted L-letter shape as integral part of the housing 20 so that it extends upward from the flat portion of the housing 20 intermediate between the two coupling arms $\mathbf{22}_1$ and $\mathbf{22}_2$ and its top end portion extends horizontally toward the center of the hole 21. The engaging piece 25 engages a hook 2G extended from the underside of the key top 2 in the vicinity of the base of the hinge portion 22, preventing the key top 2 from upward disengagement from the hinge portion 22. In the intermediate portion of the side of the coupling portion 22B facing the engaging piece 25, there is formed a guide groove 22*a* extending from the upper to the lower edge of the coupling portion 22B. Inside the opening 11*h* there are formed, as a key-top fulcrum 24, ridges which are positioned between one side of the opening 11*h* and the coupling portion of the coupling arms $\mathbf{22}_1$ and $\mathbf{22}_2$ to the housing 20 and extended at right angles to the lengthwise direction of the coupling arms $\mathbf{22}_1$ and $\mathbf{22}_2$; the key-top fulcrum 24 projects upward from the top of the housing 20 and past the engaging-piece 25 and the top panel 11. The key top 2 turns substantially about the fulcrum 24. The back surface of the coupling portion 22B abuts on the flat top of the projection 3*a* which is elastically deformed and restored by the turning of the key top 2, and the downward protrusion 3*b* causes the corresponding switching part of a membrane sheet 40 to make and break contact accordingly.

Figure 6:
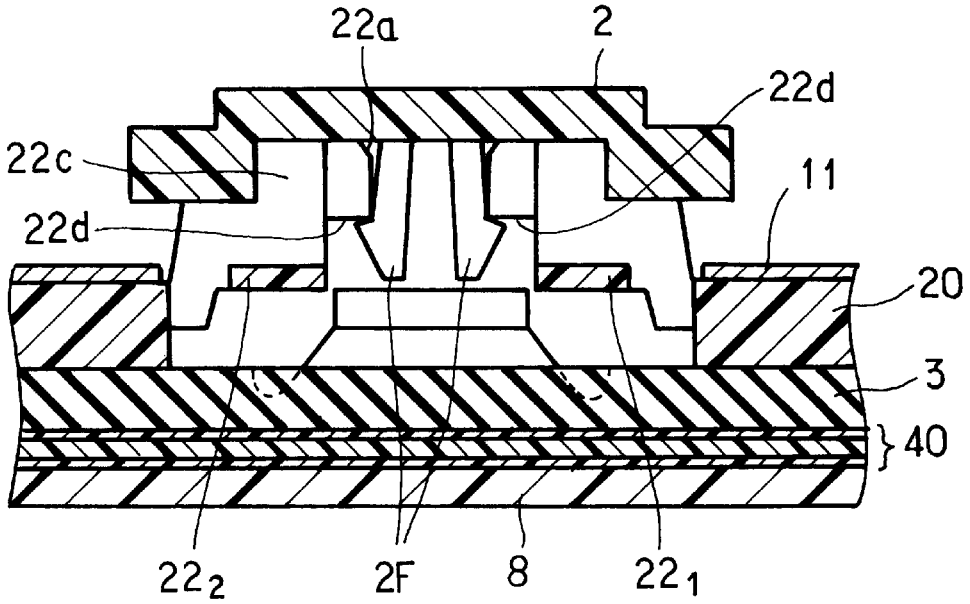
FIG. 6 is a sectional view taken along the line 6—6 in FIG. 4.

The substantially square key top 2 has in its back surface the engaging hook 2G and the pair of hooks 2F both extending downward therefrom inside the marginal portion of the key top 2 and molded integrally therewith. Further, the back surface of the key top 2 has U-shaped protrusions 2D formed adjacent one side thereof with their leg portions facing each other to form recesses 2*a*. The pair of parallel hooks 2F of the key top 2 is inserted into the guide groove 22*a* of the coupling portion 22B, while at the same time outward protrusions 22*c* contiguous to the top surface of the coupling portion 22B are pressed into the recesses 2*a* of the key top 2 together with a lug 22*f* protrusively provided on one side of the coupling portion 22B, with hooked ends of the hooks 2F engaged with stepped portions 22*d* made in both side walls of the guide groove 22*a* to hold the key top 2 in place (FIG. 6).

The top panel 11 is made of sheet metal or a film of resin such as polyethylene terephthalate (PET) and has the square openings 11*h* in a one-to-one correspondence with the hinge portions 22 of the housing 20. Each of the openings 11*h* is smaller than the outside shape of the key top 2 and has about the same size as that of the hinge receiving hole 21 of the housing 20; each opening 11*h* has such dimensions that when the keyboard has been completed, the key top 2 covers the entire area of the opening 11*h* to hide its vicinity from view substantially completely in any direction. The housing 20 has columns 26 for attachment to the backing board 8.

The membrane switch sheet 40 is made up of the upper and lower conductor pattern sheets 4A and 4B and the separator 4C sandwiched therebetween. The upper conductor pattern sheet 4A has the movable contact segments 41 each corresponding to one of the key tops 2. The lower conductor pattern sheet 4B has the fixed contact segments 42 each formed opposite one of the movable contact segments 41. The separator 4C formed by a sheet of synthetic resin has cells 4*h* each formed by punching its area surrounding the pair of opposed contact segments 41 and 42.

The thickness of the rubber sheet 3 is about the same as the height of each column 26 formed integrally with the housing 20. The rubber sheet 3 has upward projections 3*a* each formed at a position defined vertically by the underside of the coupling portion 22B of the hinge portion 22 and the switching part 4S of the membrane switch sheet 40, and the underside of the top of the projection 3*a* has a downward protrusion 3*b*. Further, the rubber sheet 3 has holes 3*d* made therein opposite the engaging portions 22*e* at the both ends of the coupling portion 22B of the hinge portion 22 to allow sufficient vertical movement of the coupling portion 22B. On the top of the backing board 8 there are bonded the membrane switch sheet 40 and the rubber sheet 3 in this order and the backing board assembly is covered with the housing 20. Lugs 8*b* formed at opposite marginal edges of the backing board 8 position the membrane switch sheet 40 and the backing board 8 is fixed to the columns 26 of the housing 20 by screws 8*s* through holes 8*a*. In FIG. 3, there are shown four switching parts 4S and the protrusion 3*a*, the hinge portion 22, the opening 11*h* and the key top 2 that correspond to one of the four switching parts 4S.

A brief description will be given of the assembling of the keyboard. The assembling starts with bonding the top panel 11 to the top of the housing 20 with the hinge portions 22 of the housing 20 and the openings 11*h* held in alignment with each other. The bonding is carried out properly using adhesive or some other method.

Next, the key tops 2 are each secured to the coupling portion 22B of the hinge portion 22 through the opening 11*h* of the top panel 22. In this instance, the hook 2G of the key top 2 is engaged with the engaging piece 25 of the housing 20 and, at the same time, the two hooks 2F are inserted into the guide groove 22*a*. By applying force between the key top 2 and the hinge portion 22 relative to each other, the hooked end of the hook 2G engages the lower marginal edge of the engaging piece 25 and the hooked ends of the two hooks 2F engage the stepped portions 22*d* formed in the lower marginal end of the guide groove 22*a*, preventing the key top 2 from upward disengagement from the housing 20 and the hinge portion 22. In this state, since the hinge portion 22 slopes upwardly as a whole and hence is elastically biased upwardly, the key top 2 engaged therewith is also biased upwardly. The back surface of that one side of the key top 2 adjoining the hook 2G is held in engagement with the key top fulcrum 24.

Then, the membrane switch sheet 40 is laid on the backing board 8 with notches 4*a* and 4*b* of sheet 40 aligned with the holes 8*a* and lugs 8*b* of the board 8, after which the rubber sheet 3 is laid and positioned on the membrane switch sheet 40. The rubber sheet 3 is bonded to the membrane switch sheet 40 with the protrusions 3*a* of the rubber sheet held in alignment with the switching parts 4S of the switch sheet 40, respectively. Finally, the housing 20 with the key tops engaged therewith is mounted on the backing board 8. In this instance, the columns 26 of the housing 20 are inserted into the holes 8*a* of the backing board 8 and the lower ends of the columns 28 projecting out of the underside of the backing board 8 are swollen by heating and pressing them to prevent the columns 26 from coming off. Thus, the keyboard is completed.

Figure 5:
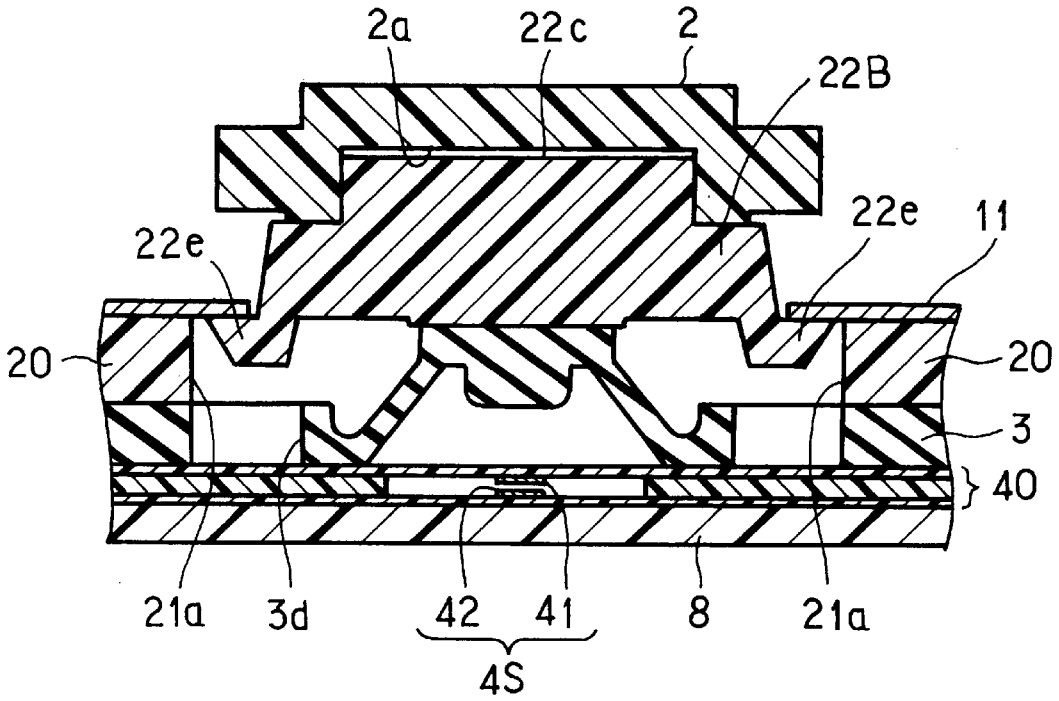
FIG. 5 is a sectional view taken along the line 5—5 in FIG. 4.

As is evident from FIG. 5, while the embodiment of the present invention also includes engaging portions 22*e* which engage the top panel 11 so as to prevent the coupling portion 22B coupling the free ends of the hinge portion 22 from projecting out of the top panel 11 in excess of a predetermined height, the size of the key top 2 can be such that it covers the entire structure of the hinge portion 22 including the engaging portions 22*e* of the coupling portion 22B. Conversely, the dimensions of the hinge portion 22 could be determined relative to a given size of the key top so that the entire structure of the former is hidden beneath the latter. This permits the fabrication of a keyboard with closely spaced key tops 2. The hinge portion 22 and the key top 2 are separate parts, but since the outward protrusions 22*c* extended from the opposite ends of the coupling portion 22B of the hinge portion 22 and the lug 22*f* formed on one side of the portion 22B are pressed into the recesses formed in the back surface of the key top 2, it is possible to prevent the key top 2 from rattling.

Since the hinge portion 22 and the key top 2 are prepared separately, the coloring of the key top can be freely chosen. In addition, since the hinge portion 22 is hidden beneath the key top 2, there is no need for attention to the coloring of the hinge portion 22 and a highly durable material, such as polypropylene, can be used.

Since the hooks 2G and 2F and U-shaped protrusions 2D for attachment of the key top 2 to the hinge portion 22 are formed inside the outer periphery of the underside of the key top 2, the opening 11*h* of the top panel 11 can be made smaller than the outside shape of the key top 2. Accordingly, when the keyboard is completed, the key top 2 entirely covers the opening 11*h* to hide its vicinity from view substantially completely in any direction—this adds a quality appearance to the keyboard. When depressed, the key top 2 turns virtually about the key top fulcrum 24 due to the turning of the hinge portion 22, and the lower surface of the coupling portion 22B presses down the top of the projection 3*a* to turn ON the switch 4S. When the key top 2 is further depressed, the lower marginal edge of its forward end portion strikes against the top panel 11 on top of the housing 20 to limit further depression of the key top 2. As the result of this, no further stress is applied to the hinge portion 22 located beneath the key top 2.

Figure 4:
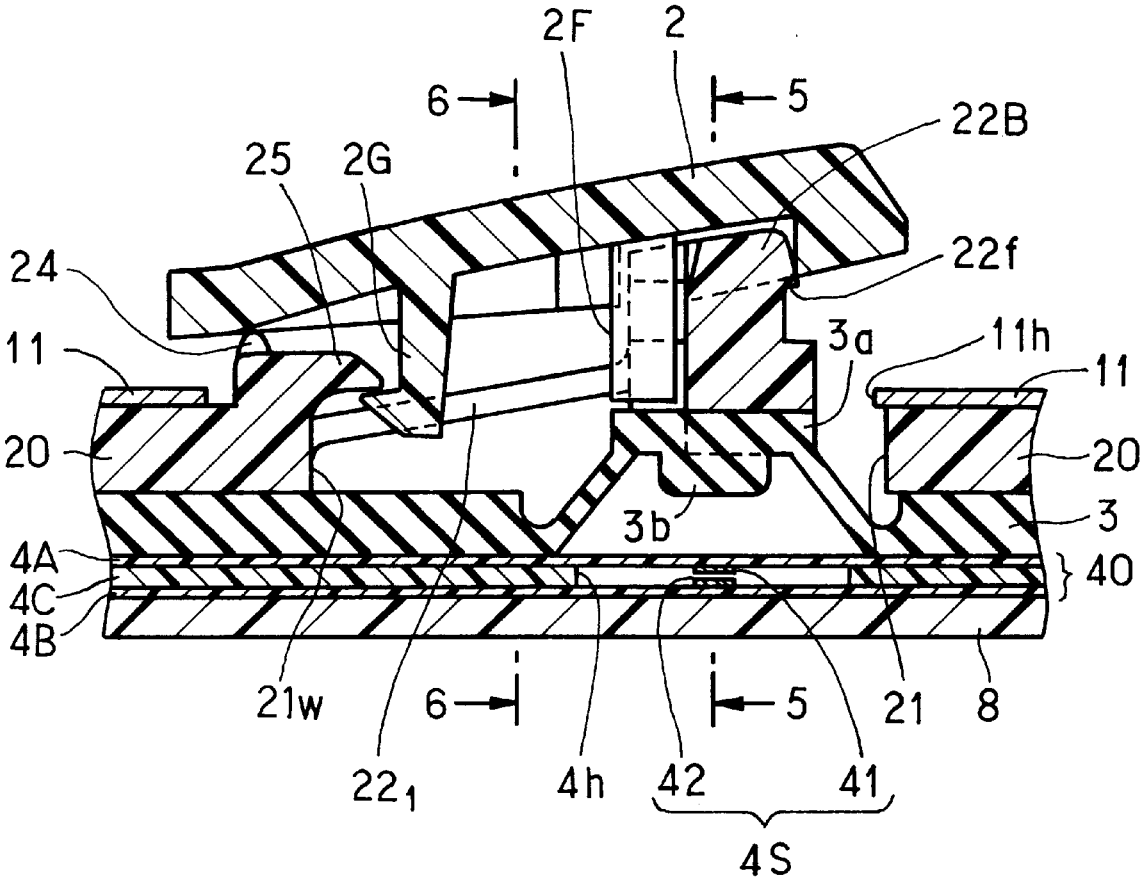
FIG. 4 is a sectional view of part of the keyboard depicted in FIG. 3.

In FIG. 4, by employing a configuration in which the height of the center of maximum vertical displacement of the contact plane between the coupling portion 22B and the projection 3*a* by the application and removal of the actuating force to and from the key top 2 is equal to the height of the center of turning of the hinge portion 22, it is possible to reduce the maximum horizontal displacement of the flat top of the projection 3*a* by the depression and release of the key top 2.

Figure 7:
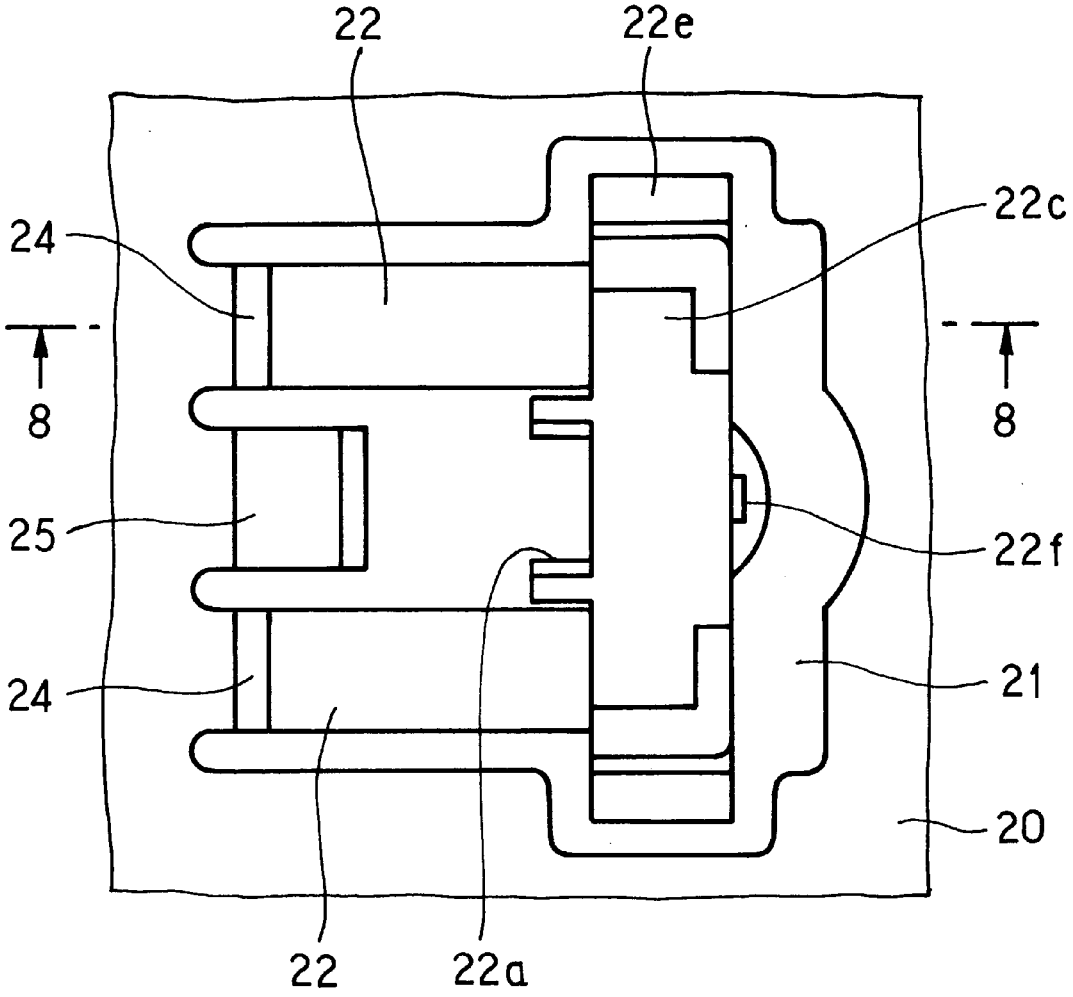
FIG. 7 is a plan view illustrating a modified form of the embodiment depicted in FIGS. 3 and 4.

While in FIGS. 3 and 4 the key top fulcrum 24 is shown to be formed on the top of the housing 20 closely adjacent to the base of the hinge portion 22, it may also be formed on the hinge portion 22 in such a manner as to shift as the key top 2 turns. FIG. 7 is a plan view of the hinge portion 22 in the hinge receiving hole 21 in such a case and FIG. 8 is a sectional view of the hinge portion taken along the line 8—8 in FIG. 7.

Figure 8:
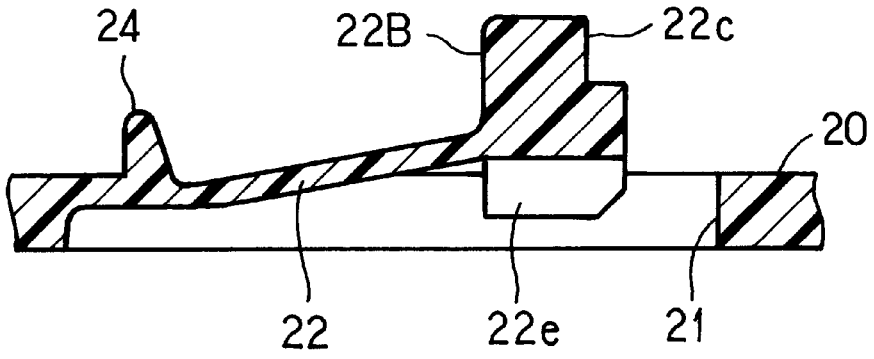
FIG. 8 is a sectional view of the hinge portion taken along the line 8—8 in FIG. 7.

As shown in FIGS. 7 and 8, the key top fulcrum 24 is formed integrally with the hinge portion 22 on the top thereof in the vicinity of its fixed portion. With this structure, the free end portion of the hinge portion 22 is displaced most by the depression of the key top 2, but since the depressing force is applied to the key top fulcrum 24 as well, the portion of the hinge portion near its base is slightly displaced downward due to elastic deformation, with the result that the fulcrum 24 itself is also displaced downward. According to the modified form depicted in FIGS. 7 and 8, when the key top 2 is depressed and released, it does not turn about a fixed point thereon but instead provides a feeling of vertical displacement of its entire structure. This embodiment is identical in construction with the embodiment shown in FIGS. 3, 4, 5 and 6, except for the above.

As described above, according to the present invention, the key top 2 is disposed in a manner to cover the entire length of the hinge portion 22 and fixedly engaged with the coupling portion at the free end portion of the hinge portion 22, so that the spacing between adjacent key tops can be reduced regardless of the length of the hinge portion. Since the key top 2 and the coupling portion 22B are fixed to each other by pressing their recesses and protrusions into engagement with each other, rattling of the key top 2 can be avoided.

Since the hinge portion 22 and the key top 2 are prepared as discrete parts, the color and material of the key top can be freely selected.

The key top 2 entirely covers the opening 11*h* to hide it from view substantially completely in a diagonal direction—this surely gives the keyboard an upscale appearance. When the key top 2 is depressed to some extent, its underside strikes against the top panel 11 on top of the housing to limit further depression, so that no further stress is applied to the hinge portion 22 underlying the key top 2 and hence the hinge portion can be protected from damage.

With the configuration according to the present invention, it is possible to realize an extremely small keyboard in which low-profile key tops about 5 mm in height are arranged at a small pitch of about 10.9 mm and are spaced less than 1 mm apart.

It will be apparent that many modifications and variations may be effected without departing from the scope of the novel concepts of the present invention.

What is claimed is:

1. A keyboard which controls switches by selectively depressing an array of key tops, comprising:

a backing board on which switch contacts for turning ON and OFF the switches and wiring patterns are formed;

an elastic sheet provided on said backing board, said elastic sheet having dome-shaped projections formed in correspondence with the switch contacts;

a housing provided on said elastic sheet, said housing having formed therein receiving holes for receiving said dome-shaped elastic projections, respectively;

hinge portions each formed integrally with said housing to extend from an inner wall surface to near an opposite inner wall surface in a corresponding one of said receiving holes, each said hinge portion having a free-end for depressing and releasing a corresponding one of said dome-shaped elastic projections to actuate ON and OFF a corresponding one of the switches;

a top panel provided on a top surface of said housing, said top panel having formed therein openings located above said receiving holes, respectively; and key tops each provided at the free-end of a corresponding one of said hinge portions to cover the entire length of said hinge portion, each key top having a top face protruding above said top panel through a corresponding one of said openings; said free-end of each of said hinge portions having an engagement protrusion formed integrally therewith on at least one side thereof, a lateral recess having a portion of said top panel as a ceiling being formed in one of opposite side walls of a corresponding one of said receiving holes to allow up-down movement of said engagement protrusion therein, said engagement protrusion being biased upward by said hinge portion to abut said ceiling, resiliently, in said lateral recess whereby said key top is positioned in its up-down direction.

2. The keyboard according to claim 1, wherein said switch contacts and said wiring patterns are formed as a membrane switch sheet on said backing board.

3. The keyboard according to claim 1, wherein another engagement protrusion is formed integrally with the free-end of each of said hinge portions on the other side thereof, another lateral recess being formed in the other one of said opposite side walls of said receiving hole under another portion of said top panel as another ceiling, said another engagement protrusion being biased upward by said hinge portion to abut said another ceiling, resiliently.

4. The keyboard according to claim 2, wherein another engagement protrusion is formed integrally with the free-end of each of said hinge portions on the other side thereof, another lateral recess being formed in the other one of said opposite side walls of said receiving hole under another portion of said top panel as another ceiling, said another engagement protrusion being biased upward by said hinge portion to abut said another ceiling, resiliently.

* * * * *